United States Patent [19]

Foster

[11] 4,157,519

[45] Jun. 5, 1979

[54] START LEAD DAMPENERS ON COIL BOBBIN

[75] Inventor: Jack V. Foster, Fort Branch, Ind.

[73] Assignee: AMF Incorporated, White Plains, N.Y.

[21] Appl. No.: 895,896

[22] Filed: Apr. 13, 1978

[51] Int. Cl.[2] ..... H01F 15/10

[52] U.S. Cl. ..... 336/192; 174/135; 339/105

[58] Field of Search ..... 336/192; 310/71; 339/105; 174/135

[56] References Cited

U.S. PATENT DOCUMENTS 4,086,465 4/1978 Sylvester ..... 339/105 X

*Primary Examiner*—Thomas J. Kozma

*Attorney, Agent, or Firm*—George W. Price; John H. Gallagher

[57] ABSTRACT

A molded plastic coil bobbin having means for securing the end lead of the coil within a groove provided in an end flange of the bobbin. The groove tapers outwardly from the cylindrical tube of the bobbin to the outer periphery of the end flange. The bobbin terminals are on each side of the groove. The flange has thin top and bottom walls above and below the groove. The end lead of the coil passes through this groove in passing from one terminal to the cylindrical tube of the bobbin. Radially extending ribs protrude downwardly and upwardly, respectively, from the top and bottom walls of the flange and serve to anchor or restrain the wire in a serpentine path in its passage through the flange. This damps vibrations that might be set up in the wire and thus minimizes the prospects that the wire will be broken due to vibrations.

4 Claims, 3 Drawing Figures

START LEAD DAMPENERS ON COIL BOBBIN

BACKGROUND OF THE INVENTION

In the electrical relay and contactor art the coil or solenoid typically is wound on a molded plastic bobbin. One type of bobbin that has been used extensively includes a thick flange at one end of the cylindrical position of the bobbin. This flange has a groove or pocket therein that extends transversely or circumferentially across the flange and radially from the periphery of the flange inwardly to the cylindrical body portion of the bobbin. The groove may be somewhat pie shaped. The lead wire of the coil passes through the groove with a transverse as well as radial component of direction. Terminals extend outwardly from each side of the groove. An opening or slit in the top wall of the flange allows the lead wire to pass from the first terminal on one side of the groove, through the groove with transverse, or circumferential, as well as radial components of direction, and then onto and around the cylindrical body portion of the bobbin. The coil then may be wound in a conventional manner onto the body portion between the end flanges of the bobbin. The free end of the coil wire then is secured to the other terminal on the other side of the radially extending groove in the thick flange. The lead wire in the groove usually is somewhat slack in order to avoid stresses therein. Coils and bobbins constructed in this general mannerr are shown in the following U.S. Pat. Nos. 3,177,294—Muszynski et al; 3,230,489—Weyrich; 3,525,965—Sparling; 3,230,490—Johnson; and 4,041,430—Hrynewycz.

It has been found that in coils wound in this manner the lead wire that is within the groove in an end flange is subject to vibrations, especially when alternating current is coupled to the coil. The vibrations have caused the lead wire in the groove to break. It has become common practice to fill the radially extending groove with a potting material in order to hold the wire in a fixed position and avoid breaks therein. This practice has been successful to accomplish its desired purpose, but it adds potting material and at least one additional step to the manufacturing procedure. In volume production, the additional material and handling amounts to a significant added cost.

SUMMARY OF THE INVENTION

According to the present invention, the problem of a vibrating coil lead wire in the radial groove on a bobbin flange is overcome by molding radially extending ribs into the top and bottom walls of the groove. The ribs are transversely displaced from each other and extend into the groove. The ribs cause the wire lead to take a serpentine path in its transverse and radial passage through the groove. Additionally, the ribs increase in height from the periphery of the flange inwardly in order to facilitate insertion of the wire lead into the groove and in order to accommodate wires of different sizes. The ribs anchor or restrain the wire lead in the groove and thus act as vibration dampers to minimize vibrations of the lead wire.

DESCRIPTION OF PREFERRED EMBODIMENT

Figure 1:
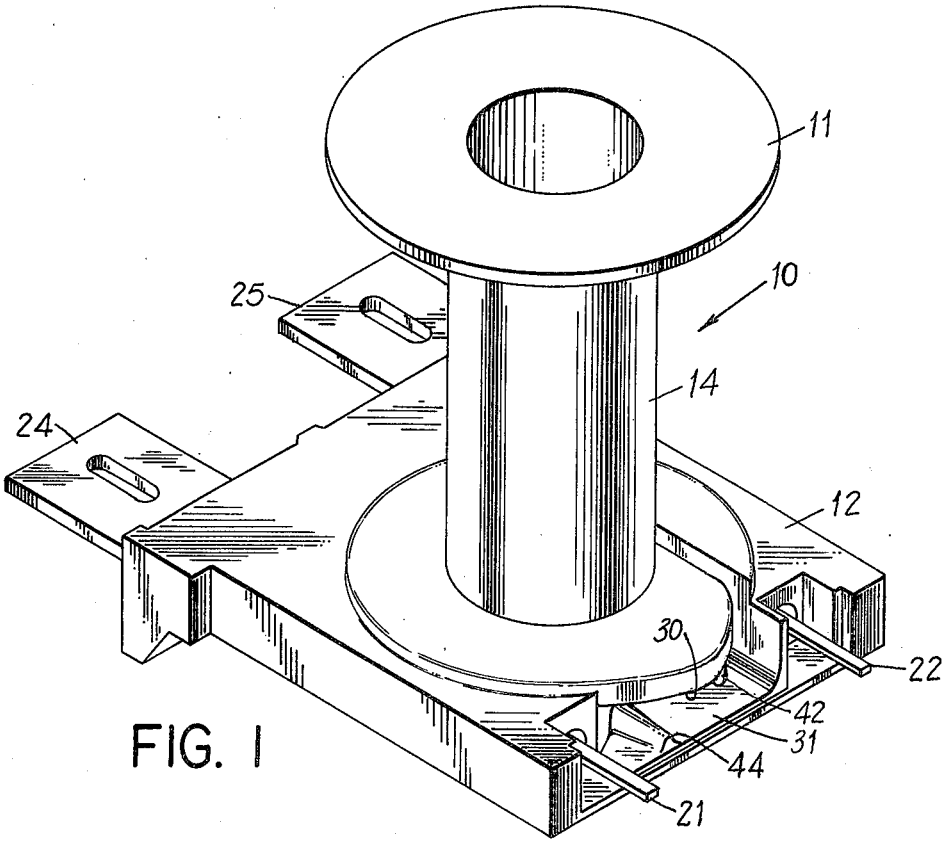
FIG. 1 is a perspective view of a bobbin constructed in accordance with the teachings of this invention.
Figure 3:
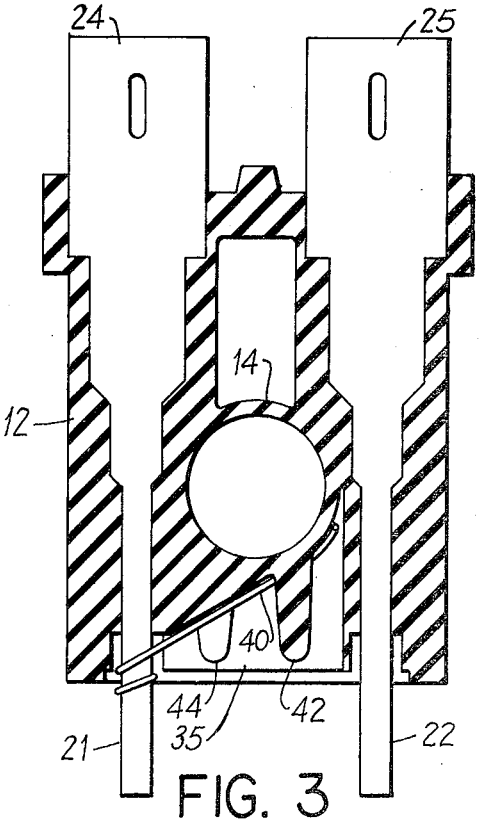
FIG. 3 is a sectional view taken through one flange of the bobbin at section 3—3 in FIG. 2.
Figure 2:
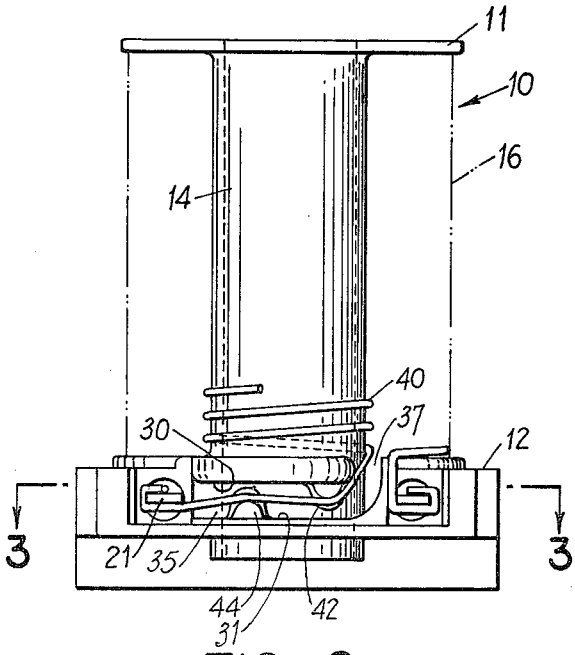
FIG. 2 is a side view of the bobbin illustrated in FIG. 1.

Referring first to FIGS. 1 and 2, the molded bobbin 10 is comprised of end flanges 11 and 12 and a central cylindrical body portion 14 upon which a wire coil 16 is wound. Electrical terminal means are molded into the second flange 12. The particular type of terminal means is not a part of this invention. The terminal means illustrated in FIGS. 1 and 3 are comprised of small strip-like terminals 21 and 22 that extend outwardly from one side of flange 12 and corresponding quick connect spade-like terminals 24 and 25 that extend outwardly from the opposite side of flange 12. As best seen in FIG. 3, terminals 21 and 24 are the extremeties of a continuous unitary terminal means, as are the terminals 22 and 25.

As illustrated in FIG. 2, the second end flange 12 includes top wall 30 and bottom wall 31. A groove or pocket 35 between top and bottom walls 30 and 31 extends from the periphery of flange 12 radially inwardly toward cylindrical body portion 14 of the bobbin. At the peripheral edge of the flange groove 35 extends transversely, or circumferentially, between terminals 21 and 22. A slit 37 in top wall 30 permits the coil wire 40 to pass therethrough.

A tapered rib 42 on the top wall 30 projects downwardly into groove 35 and extends radially inwardly from the region of the periphery of the top wall 30 to the inner end of groove 35. Rib 42 increases in thickness from its peripheral end to its inner end. A second tapered rib 44 projects upwardly from bottom wall 31 into groove 35 and extends radially inwardly from the region of the periphery of the lower wall 31 to the inward boundary of groove 35. Rib 44 tapers in height in the same manner as rib 42. As illustrated, the ribs are higher than one-half the spacing between top and bottom walls 30 and 31 in order to force the wire lead to take a serpentine like path in passing over and under them. This relationship of the height of the ribs to the spacing of the top and bottom walls is but one example. As illustrated, the two ribs are displaced from each other in a lateral transverse direction across the groove 35.

In winding a coil on the bottom illustrated in FIG. 2, the free end of a roll of wire is secured, as by wrapping and/or soldering, about terminal 21. The wire then is passed transversely and radially through groove 35 so that it passes over rib 44, under rib 42, and up through slit 37 in top wall 30 of the bottom flange. Because ribs 42 amd 44 taper in height, being shorter at the periphery and increasing in height as they extend inwardly, they present no obstacle to the wire being fed into groove 35. The wire is wound about the cylindrical body portion 14 of the bobbin a predetermined number of turns. The wire then is wrapped about, or otherwise secured to, the other terminal 22. The wire is cut and the coil is completed. Terminals 21 and 22 may be bent upwardly and tape may be applied to the coil body for protection. Alternatively, the coil may be encapsulated in a suitable plastic potting material, or it may be tape wrapped, or impregnated with insulating varnish or enclosed in a plastic molded cover, as is well known in the art.

It is seen that the serpentine path of the wire lead around ribs 42 and 43 in groove 35 tends to anchor or restrain the lead in the groove. The anchoring action provided by ribs 42 and 44 significantly reduces vibrations of the wire lead and significantly reduces the possibility that the lead will break due to vibrations. The taper on ribs 42 and 44 allows them to accommodate a range of wire sizes. Thicker wires will not go as far back on the tapered ribs and thus not as far back into groove 35 as thinner wires will. Accordingly coil wires within a given range of diameters may be used with one design of the molded bobbin.

It is seen that with the lead wire anchored in the groove 35 by tapered ribs 42 and 44, it no longer is necessary to fill the groove with a potting material in order to prvent the lead from vibrating. Thus, the potting material and extra handling is eliminated.

In the embodiment of the coil bobbin illustrated in the accompanying drawings the ribs 42 and 44 are identical in shape and height and both extend into groove 35 a distance greater than one half of the thickness of the groove. This presently is the preferred embodiment, but one rib may be higher than a rib in FIG. 2 and the other one may be shorter than an illustrated rib, so long as the wire lead must follow a serpentine like path in passing through the groove. Furthermore, it is possible, but presently not preferred, to have only one of the ribs 42 or 44 taper throughout its lenght.

Ribs 42 and 44 serve the additional function of strengthening the thin top and bottom walls 30 and 31 of groove 35. This reinforcement is advantageous because of the winding tension in the magnet wire.

In its broader aspects, this invention is not limited to the specific embodiment illustrated and described. Various changes and modifications may be made without departing from the inventive principles herein disclosed.

What is claimed is:

1. In a coil bobbin having first and second end flanges and a body portion therebetween upon which a coil is to be wound, and wherein one of the flanges has spaced top and bottom walls that form therebetween a groove or pocket that extends parallel to said walls along the peripheral edge of the flange and extends inwardly from said edge and toward the body portion, said one flange supporting at least first and second spaced terminal means, and wherein one end lead of a coil is to be secured to one of said terminals and passes transversely and inwardly across the groove and exit from the groove adjacent the body portion, the improvement comprising first and second transversely spaced ribs projecting into said groove from the top and bottom walls, respectively, of said flange, said ribs extending from the region of the peripheral edge of said walls inwardly toward the innermost boundary of the groove, said ribs extending into said groove predetermined distances to restrain an end lead wire of a coil passing transversely thereacross.

2. The coil bobbin claimed in claim 1 wherein at least one of said ribs extends into said groove a distance greater than one half the spacing between the top and bottom walls of said one flange.

3. The coil bobbin claimed in claim 1 wherein at least one of said ribs tapers in height throughout its length, the rib being shorter at the peripheral edge of the flange.

4. The coil bobbin claimed in claim 3 wherein each rib tapers along its length and extends into said groove a distance greater than one half the spacing between said top and bottom walls.

* * * * *